US011732859B2

(12) United States Patent
Goncalves et al.

(10) Patent No.: US 11,732,859 B2
(45) Date of Patent: Aug. 22, 2023

(54) VEHICLE HEADLAMP

(71) Applicant: PSA AUTOMOBILES SA, Poissy (FR)

(72) Inventors: Whilk Marcelino Goncalves, Paris (FR); Mathieu Collot, Clamart (FR); Safouane El Khadri, Pessac (FR); Valerie Molto, Versailles (FR); Philippe Poilane, Antony (FR)

(73) Assignee: PSA AUTOMOBILES SA, Poissy (FR)

( * ) Notice: Subject to any disclaimer, the term of this patent is extended or adjusted under 35 U.S.C. 154(b) by 0 days.

(21) Appl. No.: 17/638,667

(22) PCT Filed: Aug. 13, 2020

(86) PCT No.: PCT/FR2020/051516
§ 371 (c)(1),
(2) Date: Feb. 25, 2022

(87) PCT Pub. No.: WO2021/053281
PCT Pub. Date: Mar. 25, 2021

(65) Prior Publication Data

US 2022/0299185 A1 Sep. 22, 2022

(30) Foreign Application Priority Data

Sep. 17, 2019 (FR) ..... 1910235
Sep. 17, 2019 (FR) ..... 1910236

(51) Int. Cl.
*F21S 41/657* (2018.01)
*F21S 41/63* (2018.01)
(Continued)

(52) U.S. Cl.
CPC ..... *F21S 41/657* (2018.01); *F21S 41/153* (2018.01); *F21S 41/285* (2018.01); *F21S 41/635* (2018.01)

(58) Field of Classification Search
CPC ..... F21S 41/657; F21S 41/635; F21S 41/153; F21S 41/285; F21S 41/143; F21S 41/20; F21S 41/255; F21S 41/265; F21S 41/663
See application file for complete search history.

(56) References Cited

U.S. PATENT DOCUMENTS 10,823,358 B1 * 11/2020 Stein ..... B60Q 1/04
2015/0267888 A1 * 9/2015 Suwa ..... F21S 41/635 362/512
(Continued)

FOREIGN PATENT DOCUMENTS

CN 108016348 A 5/2018
DE 4435446 * 9/1995 ..... F21S 41/635
(Continued)

OTHER PUBLICATIONS

English Machine Translation of CN 108016348 provided by ESPACENET (Year: 2016).*
(Continued)

*Primary Examiner* — Zheng Song
(74) *Attorney, Agent, or Firm* — Sandberg Phoenix & von Gontard PC

(57) ABSTRACT

A headlamp for a vehicle configured to generate a lighting region (3) in front of the vehicle comprises:
a fixed matrix-array first light source configured to emit a high beam,
a movable second light source configured to emit a low beam,
a correcting mechanism configured to keep a vertical inclination of the low beam constant with respect to a reference horizontal line, when the vehicle is in motion, and
(Continued)

a dioptric prism configured to remove at least one shadow region that may occur, in said lighting region, between the high beam and the low beam.

11 Claims, 5 Drawing Sheets

(51) Int. Cl.
*F21S 41/153* (2018.01)
*F21S 41/20* (2018.01)

(56) References Cited

U.S. PATENT DOCUMENTS

2015/0345729 A1* 12/2015 Liao ..... F21S 41/176 362/510
2016/0356444 A1* 12/2016 Ohno ..... F21S 41/285
2016/0377265 A1* 12/2016 Hansen ..... F21V 9/40 362/268
2017/0146639 A1* 5/2017 Carothers ..... G01S 17/02
2017/0328533 A1* 11/2017 Ko ..... B60Q 1/0683

FOREIGN PATENT DOCUMENTS

DE 4435446 A1 9/1995
DE 19730413 A1 1/1999
DE 102019111480 * 11/2020 ..... B60Q 1/247
FR 2745061 B1 8/1997
FR 3015003 A1 6/2015
FR 3026688 B1 4/2016
FR 3032513 B1 8/2016
JP WO 2019234795 * 12/2019 ..... G03B 21/142
JP WO 2020/044418 * 3/2020 ..... F21V 14/06

OTHER PUBLICATIONS

International Search Report for PCT/FR2020/051516 dated Oct. 27, 2020.
Written Opinion for PCT/FR2020/051516 dated Oct. 27, 2020.

* cited by examiner

[Fig. 1]
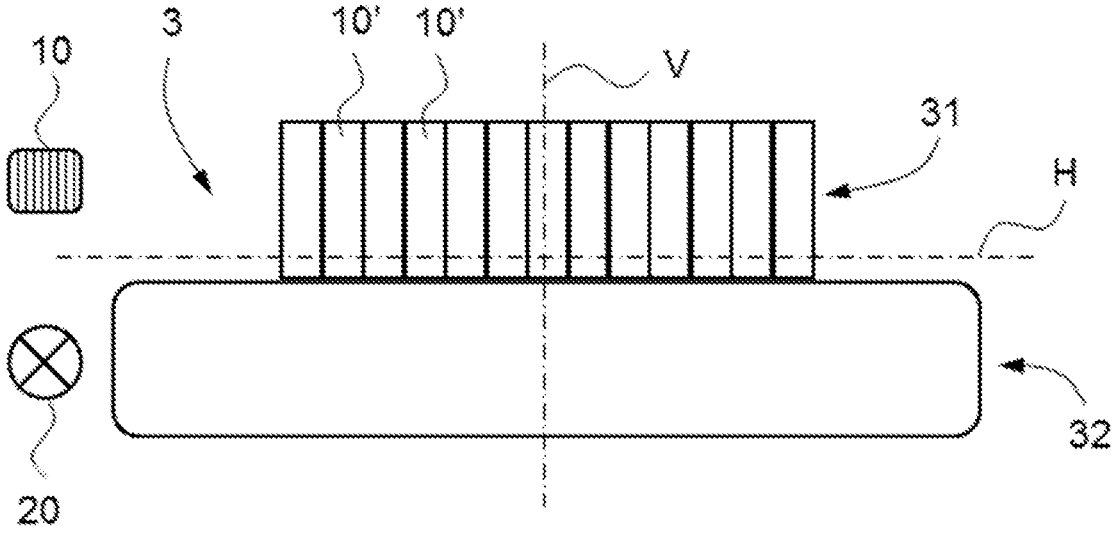
[Fig. 2]
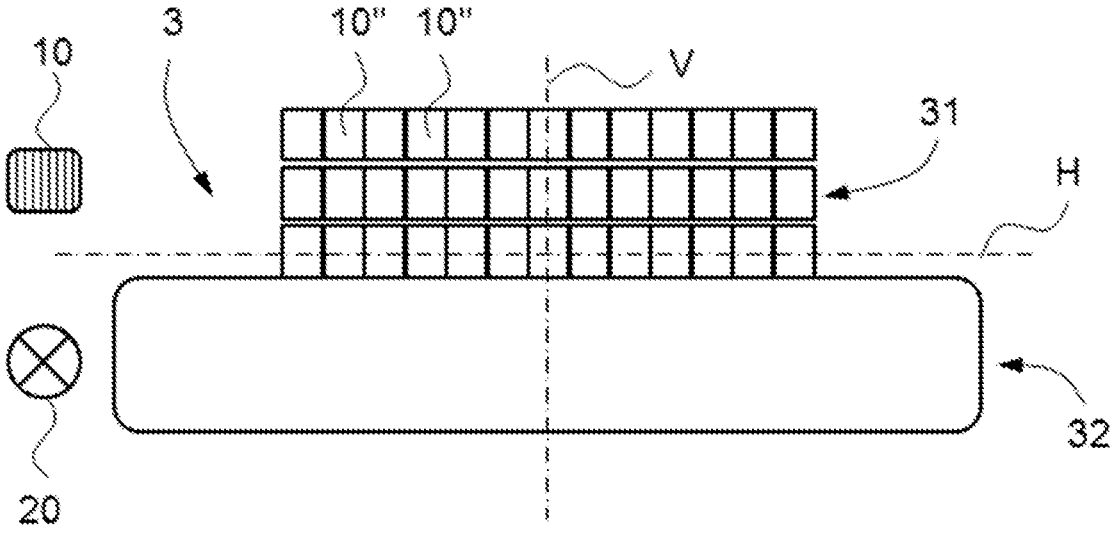

[Fig. 3]
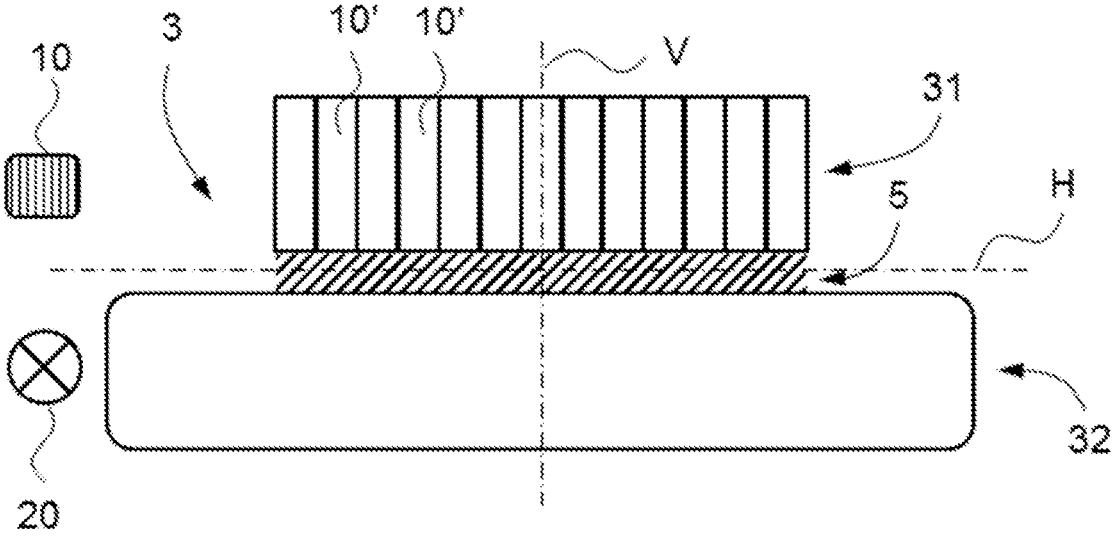
[Fig. 4]
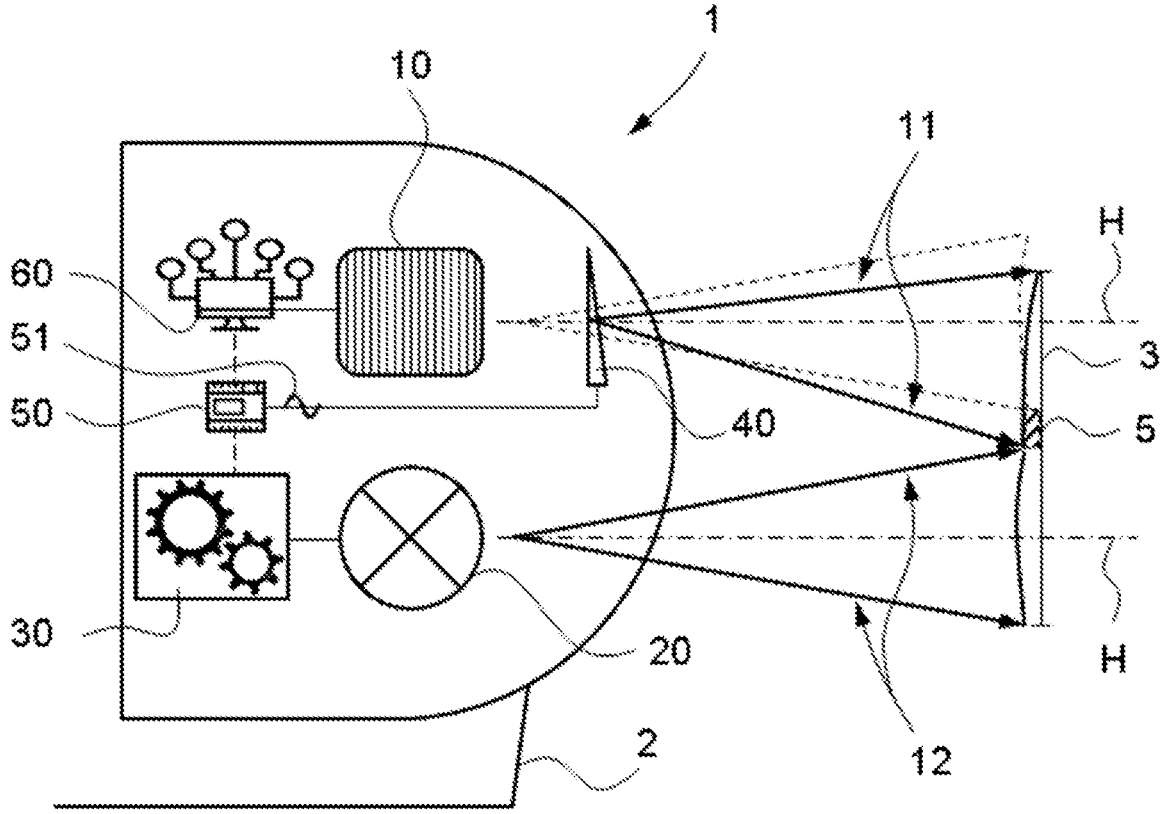

[Fig. 5]
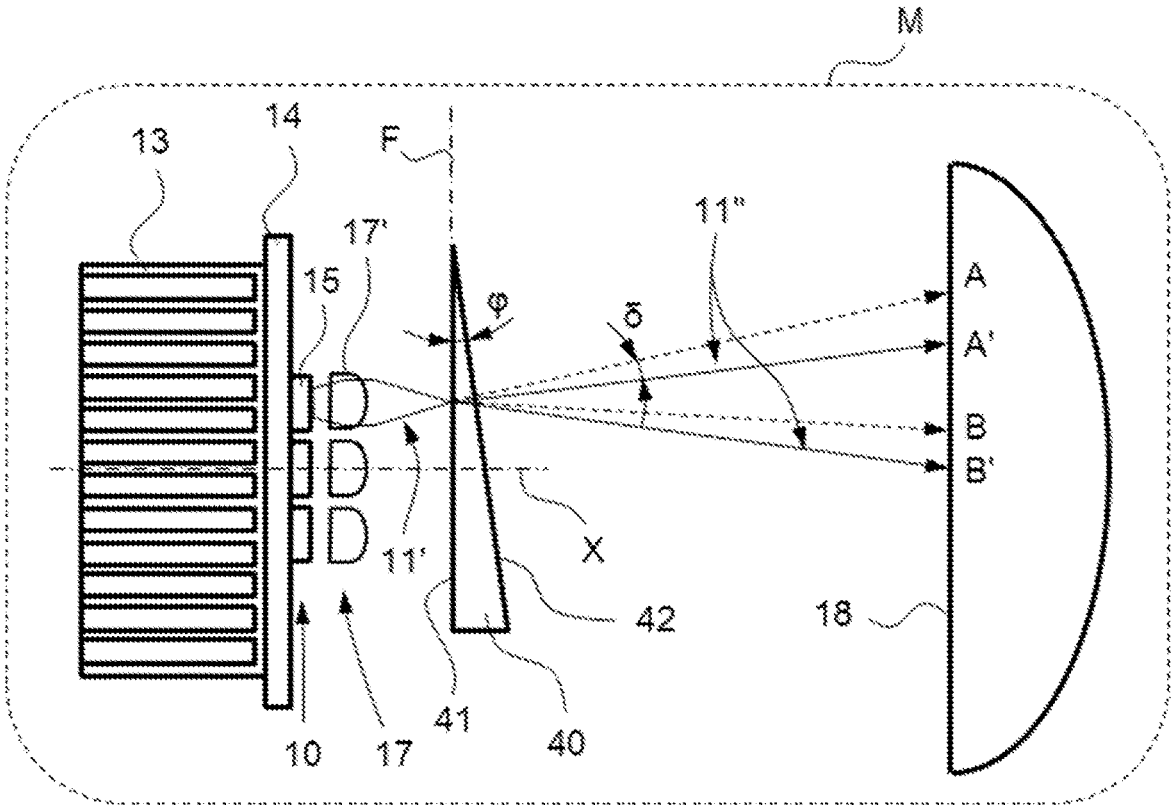

[Fig. 6]
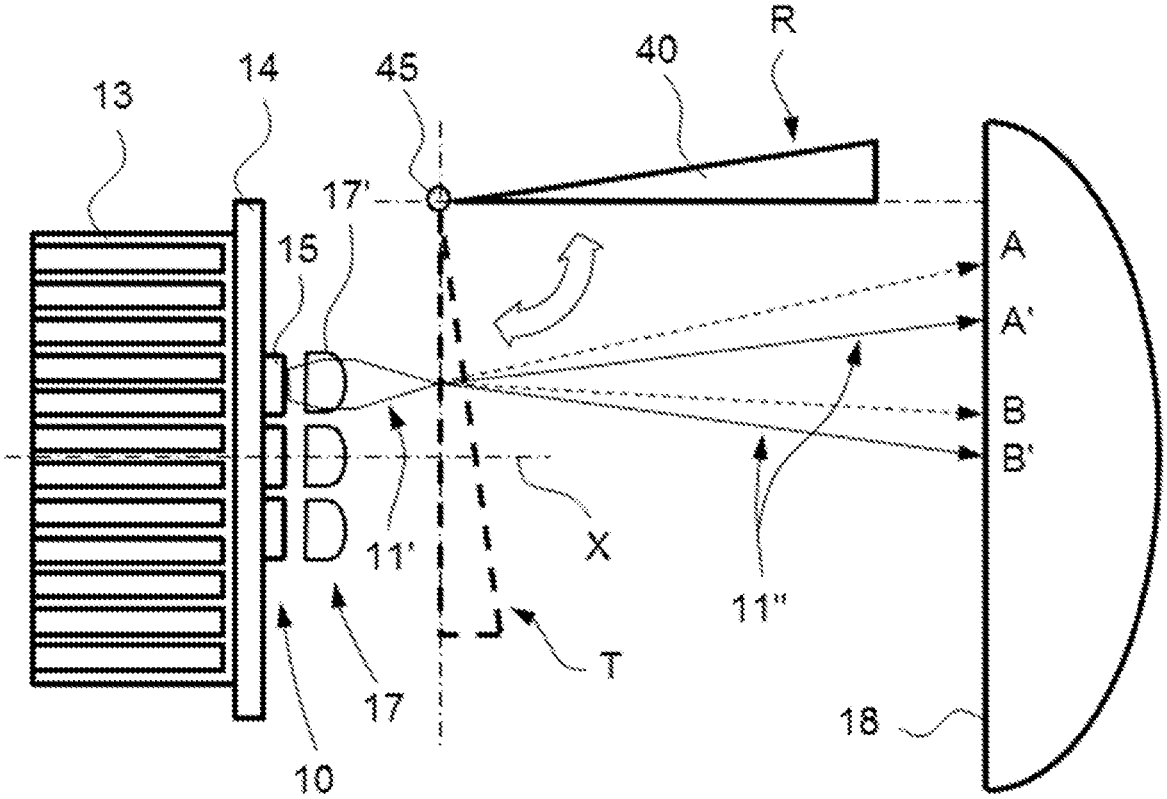

[Fig. 7]
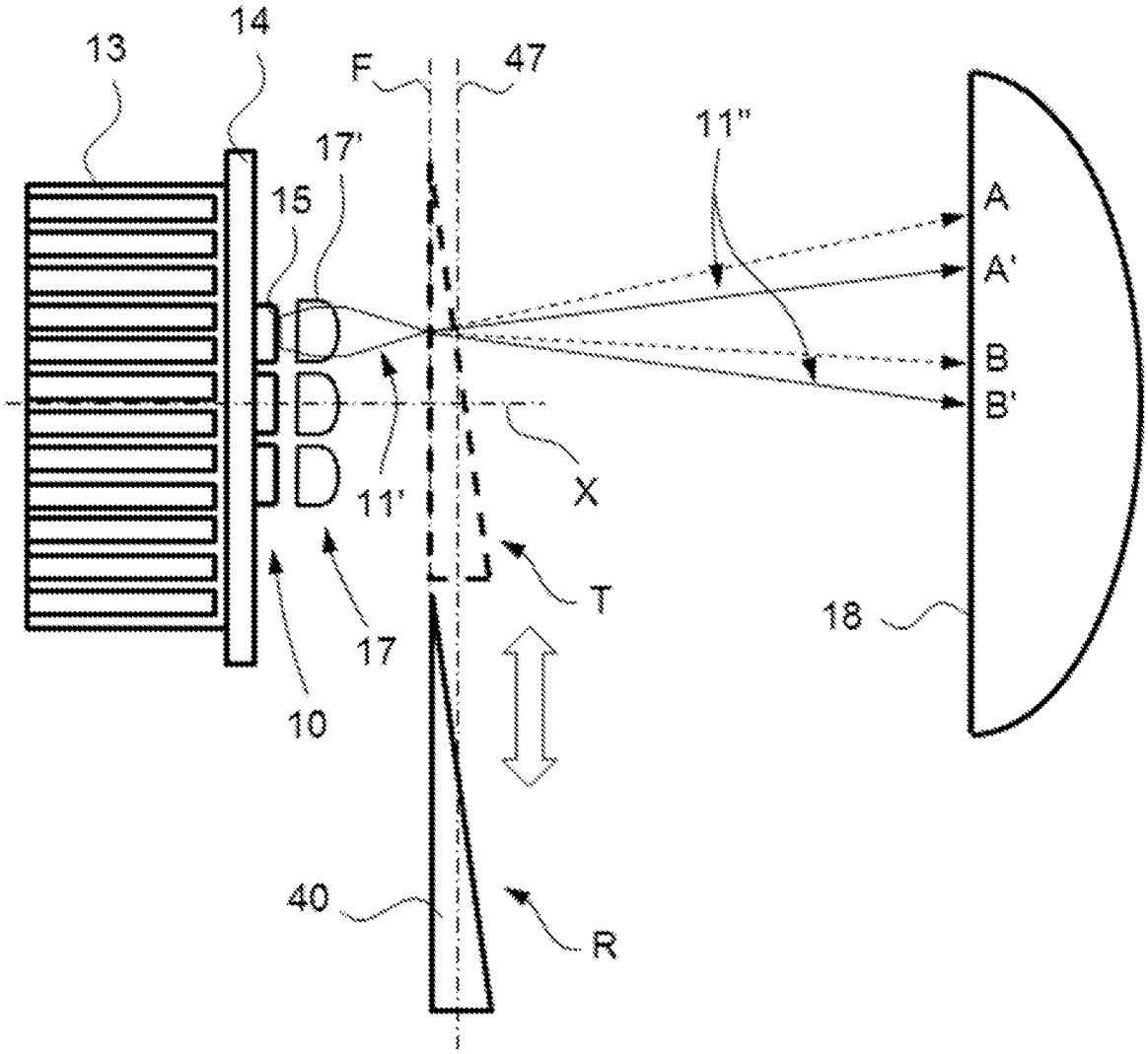

VEHICLE HEADLAMP

CROSS-REFERENCE TO RELATED APPLICATIONS

This application is the US National Stage under 35 USC § 371 of International Application No. PCT/FR2020/051516, filed 31 Aug. 2021 which claims priority to French Application Nos. 1910235 and 1910236, both of which were filed on17 Sep. 2019 and all of which are incorporated herein by reference.

BACKGROUND

The present invention generally relates to the field of vehicle headlamps, in particular motor vehicle headlamps, and in particular the field of front headlamps comprising two light sources, one generating a high beam and the other a low beam.

Vehicle headlamps or headlights generally comprise adjustment means arranged to ensure adjustment of the azimuth and elevation of the optical module. The elevation corresponds to the attitude or the inclination in the vertical plane of the optical module. Such adjustment means are described for example in Patent Application Pub. Nos. FR3032513A and FR3026688A, which in particular refer to headlamps without glass. In such a headlamp, the front face of the optical module is delimited by an outer lens, which has the advantage of reducing the absorption of part of the light (up to 10%) by the material making up the glass.

The adjustment of the elevation of the projection beam may depend for example on the load transported at the rear of the vehicle, a load which causes the front of the vehicle to lift and which typically must be compensated by such an adjustment. More sophisticated systems also allow dynamic adjustment when driving the vehicle so that the beam is never dazzling for oncoming road users. These systems are generally configured to keep an inclination of the beam constant in the vertical plane with respect to a reference horizontal line. Patent Application Pub. No. FR3015003A describes a motor vehicle headlamp devoid of glass and comprising two lighting modules equipped with elevation adjustment.

Patent Application Pub. No. FR2745061A describes a motor vehicle headlamp allowing generation of two light beams in a simple and economical way, one for a low-beam function and the other for a high-beam function, from a single source and from a mirror.

More recently, there are also matrix light beams, comprising a matrix of light-emitting diodes (LEDs) arranged on a flat support, such as a printed circuit, for example. These LEDs may be distributed in vertical bands (sometimes called a "matrix beam") where each band operates independently of the other bands. As a variant, these LEDs may be divided into pixels ("pixel light"), where each LED may be switched on or off independently.

These matrix lights are referred to as adaptive lights, known by the acronym ADB for "Adaptive Driving Beam," because they allow optimized lighting of the road without dazzling the oncoming vehicle or user. Indeed, in these types of lighting intended mainly for the high beam, lighting regions independent of one another have been created within the same beam, so as to be able to activate or switch off these regions as required. The management of the activation of the LEDs, associated with these lighting sectors or regions, may typically be controlled by an electronic unit coupled to a means of detecting the location of a target not to be dazzled within the high beam. Such detection means may be an infrared camera, for example.

An ADB-type ("matrix" or "pixel") lighting module makes the mechanical movements necessary for on-site adjustment technically complex. For this reason, headlamps fitted with an ABD module, for the high beam, and a standard module, for the low beam, only offer elevation adjustments on the standard module associated with the low beam. The ABD module therefore remains a fixed module, that is to say, immobile.

The main drawback of these headlamps lies in the fact that if only one of the two modules is adjustable in elevation, a shadow region located between the high and low beams may sometimes occur and become bothersome for the driver.

Consequently, there is an interest in finding an efficient and more adequate solution that, while remaining economical, makes it possible at least in part to resolve the aforementioned drawback.

SUMMARY OF THE INVENTION

For this purpose, a headlamp for a vehicle is disclosed which is configured to generate a lighting region in front of the In a first aspect, the headlamp comprises:

- a fixed matrix-array first light source configured to emit a high beam,
- a second movable light source configured to emit a low beam, and
- a correcting mechanism configured to keep a vertical inclination of the low beam constant with respect to a reference horizontal line when the vehicle is in motion.

The vehicle headlamp further comprises a dioptric prism configured to remove at least one shadow region that may occur, in said lighting region, between the high beam and the low beam.

Advantageously, the headlamp allows improvement to the comfort and safety of the driver of the vehicle when driving at night while offering a simple and economical solution to headlamps equipped with a two-beam architecture, one of which constitutes a matrix-array light source. In fact, the shadow region or at least a part thereof that may occur between the high and low beams, in particular when the low beam is corrected in elevation, may be eliminated using a simple compensating optical means, while keeping the ADB module fixed.

In one embodiment, the dioptric prism is movably mounted, in front of the first light source, between:

- a working position, allowing refraction of the incident rays of the high beam, and
- a rest position, with no effect on said incident rays;

and in that said dioptric prism comprises:

- a flat incident face, and
- a flat diopter from which said incident rays emerge from the dioptric prism in a refracted beam intended to project the high beam in the lighting region adjacent to or partially superimposed on the low beam.

Preferably, the dioptric prism comprises an angle, defined by said incident face and said flat diopter, configured to induce a vertical deviation of said incident rays of between 1 and 4 degrees.

In one embodiment, the rest position is a retracted position of the dioptric prism with respect to the incident rays.

According to one embodiment, the dioptric prism is rotatably mounted about an axis of rotation located outside said incident rays.

According to another embodiment, the dioptric prism is mounted to move in translation along a translation axis.

Preferably, the first light source comprises a plurality of light-emitting diodes arranged in a matrix fashion on a flat support and in that the incident face of the dioptric prism is parallel to said flat support.

In one embodiment, a primary optic, comprised of a matrix of converging lenses, is arranged in front of said flat support and the incident face of the prism is located in a focal plane of said converging lenses.

In a preferred embodiment, the dioptric prism constitutes a deflecting member that may be activated and/or deactivated by a control signal from a control member configured to prevent or detect said shadow region.

In a second aspect, a vehicle, in particular a motor vehicle, comprises a headlamp according to one of the embodiments of this headlamp or according to any possible combination of these embodiments.

BRIEF DESCRIPTION OF THE FIGURES

FIG. 1 is a schematic illustration of a lighting region obtained by a matrix-array first light source of a first type and by a second standard light source;

FIG. 2 is a schematic illustration, similar to that of FIG. 1, in which the matrix-array first light source is of a second type;

FIG. 3 is a schematic illustration of the shadow region that may occur between the beams of the aforementioned first and second light sources;

FIG. 4 is a schematic illustration of the main elements of a headlamp;

FIG. 5 is a schematic illustration, in side view, of the fixed matrix-array first light source;

FIG. 6 is an illustration of an embodiment of the first light source in a view similar to that of FIG. 5; and FIG. 7 is an illustration of another embodiment of the first light source according to a representation similar to that of FIG. 6.

DETAILED DESCRIPTION

FIG. 1 schematically shows a lighting region 3 obtained by a matrix-array first light source 10 and by a standard second light source 20. More precisely, the first source 10 produces a first lighting region 31 and the second source 20 produces a second lighting region 32. In the present case, these first and second lighting regions 31, 32 may be qualified as partial lighting regions since they form the lighting region 3 only when they are considered together.

An orthonormal reference formed by a horizontal axis H and a vertical axis V is illustrated superimposed on the lighting region 3. The lighting of the first source 10 is of the matrix array type and is formed by a plurality of vertical lighting strips 10' aligned adjacently one beside the other. Each vertical lighting strip 10' may typically be obtained from a column of light-emitting diodes (LEDs) constituting a portion of the first source 10. The advantage of this type of lighting lies in the fact that each vertical lighting strip 10' may be switched on or off independently.

By coupling the first light source 10 to a matrix-array lighting management member 60 (FIG. 4), it becomes possible to control each of the vertical lighting strips 10' based on the needs of the moment. In particular, combining an infrared camera or any other on-board detection system (in night conditions) for detecting a target liable to be dazzled may then allow selection of the vertical lighting strips 10' that, for example, must be turned off so as not to bother the target, in particular when it is an oncoming vehicle or pedestrian. This matrix-array first light source 10 may be described as adaptive since it is capable of dynamically generating an adaptive or modulating beam. For this reason, such a type of lighting is generally known by the acronym ADB ("Adaptive Driving Beam").

While the matrix-array first light source 10 is typically used as a high beam, the second, more modest light source is generally dedicated to the low beam. This second source 20 is usually not of the matrix array type, but is more conventionally made up of a bulb, for example a halogen or xenon bulb.

To improve the driver's night vision and avoid dazzling oncoming road users, an additional measure is applied to the headlamps of recent vehicles. This measure consists in dynamically correcting the elevation lighting of the second source 20 dedicated to low-beam headlights. For information, such an adjustment consists in varying the average angle of projection of the low-beam light beam in the vertical plane, so as to correct the height of the partial lighting region 32 with respect to a reference horizontal line or axis H. The correction takes place dynamically, i.e. at all times while the vehicle is in motion. Typically, the upper radius of the high beam will usually be set so that it is at an inclination of 0.57° below the reference horizontal line H. This inclination corresponds to an angle having a slope of 1% pointing downward from the source.

FIG. 2 shows a variant of the illustration provided in FIG. 1. Indeed, in FIG. 2, the matrix-array lighting of the first source 10 is "pixel"-type lighting in which the vertical lighting strips 10' have been further subdivided by horizontal lines so as to obtain a multitude of pixels 10". Each pixel 10" may consist of an LED diode or an array of a plurality of LED diodes. The advantage of such a light source lies in the fact that the granulometry of the light offers finer partitioning than that provided by the first source 10 shown in FIG. 1.

FIG. 3 schematically shows the main problem presented by headlamps provided with light sources 10, 20, such as those illustrated either in FIG. 1 or 2. Because one of the two light sources, in particular the second source 20 generating the low beam, is dynamically corrected in elevation, a shadow region 5 may sometimes appear in the lighting region 3, between the partial lighting regions 31, 32. This shadow region 5 occurs as a function of the inclination or attitude of the vehicle with respect to the profile of the terrain and may constitute a nuisance for the driver of the vehicle in particular. The object of the present invention aims in particular to counter this drawback, at least in part.

It should be noted that due to the complexity of the optical module necessary for the matrix-array first light source 10, this lighting is preferably made fixed or immobile. Consequently, the first source 10 generating the high beam must be considered as not being able to be inclined in elevation, unlike the second source 20 generating the low beam.

As shown very schematically in FIG. 4, to at least partially solve the aforementioned problem, a headlamp 1 for a vehicle 2 is configured to generate a lighting region 3 in front of the vehicle 2. This headlamp or headlight of the vehicle may be provided with protective glass or preferably be free of such glass.

The headlamp 1 comprises:

- a fixed matrix-array first light source 10 configured to emit a high beam 11,
- a second movable light source 20 configured to emit a low beam 12, and a correcting mechanism 30 configured to keep a vertical inclination of the low beam 12 constant with respect to a reference horizontal line H, when the vehicle 2 is in motion.

The headlamp 1 further comprises a dioptric prism 40 configured to remove at least one shadow region 5 that may occur in said lighting region 3 between the high beam 11 and the low beam 12.

It will be noted that the movable second light source 20 is in no way limited to being able to provide a correction in elevation, namely a correction in the vertical plane, but could also be configured to be able to provide a correction in azimuth, namely a correction in the horizontal plane. The elevation and/or azimuth correction is therefore also a dynamic correction, that is to say, a correction that is carried out, preferably continuously, when the vehicle is in motion. Thus, such a correction will not be confused with an occasional adjustment of the optics conferred by a system for occasional adjustment of said optics. Such an adjustment may, for example, be aimed at compensating the attitude of the vehicle in a single or occasional manner due to the load it is carrying, or may consist of a manual adjustment of the optics by means of adjustment screws generally manipulated by a mechanic, during technical inspections of the vehicle, for example. Finally, the vertical inclination (namely in elevation) of the low beam 12 with respect to the reference horizontal line V is preferably not zero, as schematically illustrated in FIG. 4, but is rather directed downward (below the horizontal line H), as illustrated in particular in FIGS. 1 to 3.

Owing to the dioptric prism comprised by the headlamp 1, the shadow region(s) 5 illustrated in FIGS. 3 and 4 may advantageously be eliminated, at least in part, without modifying either the fixed matrix-array first light source 10, or the second mobile light source 20. Thus, the technology required by the matrix-array first light source is spared any additional device aimed at making it mobile, which avoids embrittlement or complexification of this matrix-array first light source. In addition, the adaptation of existing headlamps, provided with such first and second light sources, is thereby facilitated by the easy addition of a deflecting member such as the prism 40 in order to be able to counter the drawback constituted by the shadow region 5 for the driver of the vehicle. Therefore, the adaptation of such headlamps advantageously finds a solution that is as economical as it is effective.

FIG. 5 is a schematic illustration, in side view, of the fixed matrix-array first light source 10. It is noted in this figure that this first source 10 is preferably part of an optical module M preferably comprising a radiator 13 associated with a printed circuit on which a matrix of light-emitting diodes 15, a primary optic 17 and a secondary optic 18 is arranged. As illustrated in this figure, the presence of the dioptric prism 40 allows deflection of the light rays A and B in a downward vertical plane and obtaining of the light rays A' and B', respectively, before projecting the latter toward infinity through the secondary optic 18. This secondary optic 18 may typically consist of a projection lens.

The dioptric nature of the prism 40 gives it the ability to be able to refract light and, therefore, to be able to deflect the high beam 11 from a certain vertical inclination directed downward, as schematically illustrated in FIG. 4. The prism 40 is preferably an optical glass prism, for example crown glass, or polymethyl methacrylate (Plexiglas). The deflecting power of the dioptric prism depends on the angle φ of the prism and on its refractive index n, more particularly on the refractive index of the material that constitutes this prism.

According to a preferred embodiment of the headlamp illustrated by FIGS. 6 and 7, the dioptric prism 40 is movably mounted, in front of the first light source 10, to be movable between:

a working position T, allowing refraction of the incident rays 11' of the high beam 11, and a rest position R, with no effect on said incident rays 11'.

Additionally, and as best illustrated in FIG. 5, the dioptric prism 40 comprises:

a flat incident face 41, and a flat diopter 42 from which the incident rays 11' emerge from the dioptric prism 40 in a refracted beam 11" intended to project (or configured to project) the high beam 11 in the lighting region 3 in a manner adjacent to or partially superimposed on the low beam 12.

It will be understood that the incident rays 11' are more precisely rays located at the source of the high beam 11.

Preferably, the incident face 41 is perpendicular to the optical axis X of the matrix-array first light source 10. In other words, the incident rays 11' form an incident beam that is preferably perpendicular to the incident face 41 of the dioptric prism. The flat diopter 42 constitutes a surface separating the transparent media, i.e., the air and the prism material. These media are considered to be homogeneous and isotropic.

As shown in FIG. 5, the angle φ of the prism is defined by the incident face 41 and by the flat diopter 42. Preferably, the angle φ of the prism is configured to induce a vertical deviation δ, namely a deviation in the vertical plane or in elevation, of the incident rays 11'. This deviation is preferably between 1 and 4 degrees so that it has a slope (directed downward) of the order of 2% to 7%. To obtain such a deviation, the angle φ of the prism could be between 2 and 4.5 degrees and the refractive index n of the prism 40 could be between 1.49 and 1.90, thereby including materials such as polymethyl methacrylate (Plexiglas) as well as the full range of optical glasses.

In one embodiment, the rest position R is a retracted position of the dioptric prism 40 with respect to the incident rays 11'.

FIG. 6 is a schematic illustration of an embodiment in which the dioptric prism 40 is rotatably mounted about an axis of rotation 45 located outside said incident rays 11'. Advantageously, this embodiment is a relatively compact mode that would make it possible to preserve the existing dimensions of the optical module M dedicated to the first light source 10.

FIG. 7 is a schematic illustration of another embodiment in which the dioptric prism 40 is mounted to move in translation along a translation axis 47.

Independent of the way in which the prism 40 is made movable, this mobility may easily be obtained from a simple mechanism using, for example, an actuator such as a stepper motor, a DC motor, a solenoid or a piezoelectric device.

As illustrated in FIGS. 5 to 7, the matrix-array first light source 10 preferably comprises a plurality of light-emitting diodes 15 arranged in a matrix fashion on a flat support 14. Such a support 14 may advantageously comprise the printed circuit on which the LED diodes are arranged. The matrix arrangement of these LEDs may define both vertical lighting strips 10' (FIG. 1) and pixels 10" (FIG. 2). The number of LEDs, vertical lighting strips 10' or pixels 10" remains irrelevant. Preferably again, the incident face 41 of the dioptric prism 40 is parallel to the flat support 14.

Preferably again, the primary optic 17 is comprised of a matrix of converging lenses 17'. In a preferred embodiment, this primary optic is arranged in front of the flat support 14 and the incident face 41 of the prism 40 is located in a focal plane F of the converging lenses 17'. Preferably again, these converging lenses are all identical and therefore all have identical focal lengths. Therefore, the matrix of converging lenses 17' of the primary optic 17 is preferably arranged in coincidence with the matrix of LEDs so that each LED is associated with a converging lens of the primary optic. Preferably again, the focal plane F of the primary optic 17 also comprises the focal point of the secondary optic 18 (projection lens).

As shown in FIGS. 6 and 7, the dioptric prism 40 constitutes an activatable and/or deactivatable deflecting member. As shown in FIG. 4, the activation or deactivation of this deflecting member may preferably be controlled by a control signal from a control member 50. This control member 50 could be configured to prevent or detect the shadow region 5.

In one embodiment, the control member 50 could be a control member for the angle of inclination (elevation) of the correcting mechanism 30 and could be configured to generate and transmit, to the deflecting member (prism 40), the control signal 51 when the angle of inclination (in the vertical plane) reaches a threshold value. This threshold value could be a predefined value corresponding for example to an angle having a slope (oriented downward) of 2% or less than this value. The above-mentioned angle of inclination typically corresponds to the attitude of the vehicle 2 and could be determined by the correcting mechanism 30 and/or come from the latter.

The control signal 51 could be a binary signal or a more complex signal conveying at least one complementary piece of information or data.

In one embodiment, the control signal 51 comprises:

an activation signal transmitted to the deflecting member (prism 40) when the angle of inclination is greater than or equal to the threshold value, and a deactivation signal transmitted to the deflecting member when the angle of inclination is less than this threshold value.

As a variant, the control signal could consist of a single activation or deactivation signal in the case where the default position of the deflecting member is the rest position R or the working position T, respectively.

In one embodiment, the control member 50 is a member for detecting the shadow region 5. Such a member could be a camera or another member of the electro-optical type in particular.

In another embodiment, the control signal 51 is configured to be subordinated to a management member 60 of the matrix-array light of the first source 10. By this means, it could be possible to deactivate the deflecting member (prism 40) in the presence of a target located or detected in the lighting region 3, between the high beam 11 and the low beam 12. Such a target could be an oncoming pedestrian or vehicle that should not be dazzled so as not to hinder its movement. The management member 60 could be the same unit as that dedicated to managing the LEDs of the matrix-array first light source. Such a management member 60 could therefore include a microcomputer or at least one processor provided with firmware.

In a second aspect, a vehicle 2, in particular a motor vehicle, comprises a headlamp 1 according to one of the embodiments of this headlamp or according to any possible combination of these embodiments.

Additional features of the headlamp relate, in a first aspect, to a vehicle headlamp, configured to generate a lighting region in front of the vehicle and comprising:

a fixed matrix-array first light source configured to emit a high beam, a second movable light source configured to emit a low beam, and a correcting mechanism configured to keep a vertical inclination of the low beam constant with respect to a reference horizontal line when the vehicle is in motion.

Here, the vehicle headlamp further comprises a dioptric lens, having at least one flat incident face, configured to remove at least one shadow region that may occur, in said lighting region, between the high beam and the low beam.

Advantageously, the headlamp according to the first aspect of the additional features allows improvement to the comfort and safety of the driver of the vehicle when driving at night while offering a simple and economical solution to headlamps equipped with a two-beam architecture, one of which constitutes a matrix-array light source. In fact, the shadow region or at least part of the latter that may occur between the high and low beams, in particular when the latter is corrected in elevation, may be eliminated using a simple compensating optical means, while keeping the ADB module fixed.

In one embodiment of the first aspect of the additional features, the dioptric prism is movably mounted, in front of the first light source, for movement between:

at least one working position, allowing refraction of the incident rays of the high beam, and a rest position, with no refraction effect on said incident rays;

and in that said dioptric lens comprises an emerging face from which said incident rays emerge in a refracted beam intended to project the high beam in the lighting region adjacent to or partially superimposed on the low beam.

In an embodiment of the first aspect of the additional features, the dioptric lens is mounted movably along a translation axis, and said emerging face constitutes an at least partially curved diopter, having a variable deflection power of the refracted beam that depends on the position of the dioptric lens on said translation axis.

In an embodiment of the first aspect of the additional features, said diopter also comprises a portion parallel to the incident face of the dioptric lens, and said parallel portion comprises the rest position of the dioptric lens.

Preferably, the first light source comprised of a plurality of light-emitting diodes arranged in a matrix fashion on a flat support and in that the incident face of the dioptric lens is parallel to said flat support.

In one embodiment of the first aspect of the additional features, a primary optic, comprised of a matrix of converging lenses, is arranged in front of said flat support and in that the flat incident face of the dioptric lens is located in a focal plane of said converging lenses.

In a preferred embodiment of the first aspect of the additional features, the dioptric lens constitutes a deflecting member that may be activated and/or deactivated by a control signal from a control member configured to prevent or detect said shadow region.

Preferably, the control member is a control member of an angle of inclination of the correcting mechanism and this member is configured to generate said control signal and transmit it to the deflecting member when said angle of inclination reaches a threshold value.

In another embodiment of the first aspect of the additional features, said control signal is configured to be subordinated to a matrix-array light management member of the first source, in order to be able to deactivate the deflecting member in the presence of a target located, in the lighting region, between the high beam and the low beam.

A second aspect of the additional features also relates to a vehicle, in particular a motor vehicle, comprising a headlamp according to one of the embodiments of this headlamp or according to any possible combination of these embodiments.

The invention claimed is:

1. A headlamp for a vehicle, configured to generate a lighting region in front of the vehicle and comprising:

a fixed matrix-array first light source configured to emit a high beam, a movable second light source configured to emit a low beam, a correcting mechanism configured to keep a vertical inclination of the low beam constant with respect to a reference horizontal line, when the vehicle is in motion, and a dioptric prism configured to remove at least one shadow region that may occur in said lighting region, between the high beam and the low beam, wherein the dioptric prism is movably mounted, in front of the first light source, to be movable between:

a working position, allowing refraction of the incident rays of the high beam, and a rest position, with no effect on said incident rays;

and in that said dioptric prism comprises:

a flat incident face, and a flat diopter from which the incident rays emerge from the dioptric prism in a refracted beam intended to project the high beam in the lighting region in a manner adjacent to or partially superimposed on the low beam.

2. The headlamp according to claim 1, wherein the first light source comprises a plurality of light-emitting diodes arranged in a matrix fashion on a flat support and wherein the incident face of the dioptric prism is parallel to said flat support.

3. The headlamp according to claim 2, wherein a primary optic, comprising a matrix of converging lenses, is arranged in front of said flat support and wherein the incident face of the prism is located in a focal plane of said converging lenses.

4. The headlamp according to claim 1, wherein the rest position is a retracted position of the dioptric prism with respect to the incident rays.

5. The headlamp according to claim 1, wherein the dioptric prism is rotatably mounted about an axis of rotation located outside said incident rays.

6. The headlamp according to claim 1, wherein the dioptric prism is mounted to move in translation along a translation axis.

7. A vehicle, comprising the headlamp according to claim 1.

8. A headlamp for a vehicle, configured to generate a lighting region in front of the vehicle and comprising:

a fixed matrix-array first light source configured to emit a high beam, a movable second light source configured to emit a low beam.

a correcting mechanism configured to keep a vertical inclination of the low beam constant with respect to a reference horizontal line, when the vehicle is in motion, and a dioptric prism configured to remove at least one shadow region that may occur in said lighting region, between the high beam and the low beam, wherein the dioptric prism comprises an angle, defined by said incident face and said flat diopter, configured to induce a vertical deviation of the incident rays of the high beam of between 1 and 4 degrees.

9. A vehicle, comprising the headlamp according to claim 8.

10. A headlamp for a vehicle, configured to generate a lighting region in front of the vehicle and comprising:

a fixed matrix-array first light source configured to emit a high beam, a movable second light source configured to emit a low beam, a correcting mechanism configured to keep a vertical inclination of the low beam constant with respect to a reference horizontal line, when the vehicle is in motion, and a dioptric prism configured to remove at least one shadow region that may occur in said lighting region, between the high beam and the low beam, wherein the dioptric prism comprises a deflecting member that may be activated and/or deactivated by a control signal from a control member configured to prevent or detect said shadow region.

11. A vehicle, comprising the headlamp according to claim 10.

* * * * *